US006323767B1

(12) United States Patent
Gropper

(10) Patent No.: US 6,323,767 B1
(45) Date of Patent: Nov. 27, 2001

(54) DIAGNOSTIC FSK RECEIVER FOR DECODING EAS AND SAME WITH USER DEFINABLE TRANSLATIONS

(76) Inventor: Daniel R. Gropper, P.O. Box 625, Vienna, VA (US) 22183

( * ) Notice: Subject to any disclaimer, the term of this patent is extended or adjusted under 35 U.S.C. 154(b) by 0 days.

(21) Appl. No.: 09/589,826

(22) Filed: Jun. 8, 2000

Related U.S. Application Data

(60) Provisional application No. 60/138,306, filed on Jun. 9, 1999.

(51) Int. Cl.[7] ..... G08B 1/08

(52) U.S. Cl. ..... 340/534; 340/539; 375/272

(58) Field of Search ..... 340/531, 534, 340/539, 601, 691.1, 691.3, 691.4, 691.6, 825.72, 7.51, 7.52, 7.49; 455/161.1, 161.3, 186.1; 379/33, 43, 48; 375/219, 272, 275

(56) References Cited

U.S. PATENT DOCUMENTS

| | | | | |
|---|---|---|---|---|
| 4,141,006 | | 2/1979 | Braxton | 340/505 |
| 4,415,771 | | 11/1983 | Martinez | 379/43 |
| 5,121,430 | | 9/1998 | Ganzer | 725/33 |
| 5,276,909 | * | 1/1994 | Milner et al. | 340/7.49 |
| 5,548,323 | | 8/1996 | Callahan | 725/33 |
| 5,574,999 | * | 11/1996 | Gropper | 455/186.1 |
| 5,781,852 | * | 7/1998 | Gropper | 455/227 |
| 5,917,887 | | 6/1999 | Fesler | 379/48 |
| 5,978,738 | * | 11/1999 | Brown | 702/3 |
| 5,995,553 | * | 11/1999 | Crandall et al. | 375/272 |
| 6,204,761 | * | 3/2001 | Vanderable | 340/539 |

OTHER PUBLICATIONS

MTS 3000D EAS pp. 22, 26.
Harris Sage ENDEC.
MTS Ear Fact Sheet.

* cited by examiner

*Primary Examiner*—Van T Trieu
(74) *Attorney, Agent, or Firm*—Daniel R. Gropper

(57) ABSTRACT

This invention teaches a method and apparatus of LEDS, non volatile memory, an LCD, microcontrollers and a keypad to quickly determine the decoding status of EAS and SAME messages; a method and apparatus for the user to define the translation of these messages into custom text messages, abbreviations and different languages; and a method and apparatus for interfacing the decoded messages to alphanumeric paging, personal communication text messaging services, internet, email and remote LED signboards boards by hardware, modem and pager.

22 Claims, 3 Drawing Sheets

Figure 7

2- SAME Preamble
ABh (10101011) x 16

4- SAME Header
ZCZC-ORG-EEE-PSSCCC+TTTT-JJJHHMM-LLLLLLLL

6- ORG=Originator, such as NWS for National Weather Service

8- EEE=Event, such as TOR for Tornado Warning

10-PSSCCC= 12-P=portion of county
14-SS=state
16-CCC=county such as 051059 for 0=entire area
51=Virginia
059=Fairfax County 18- TTTT=Time in Zulu such as 0015

20- JJJHHMM=Julian Date, Hour and Minute
22-24-26

28- LLLLLLLL=call sign of the originator such as KLWX/NWS for Baltimore/Washington NWS Forecast Office

DIAGNOSTIC FSK RECEIVER FOR DECODING EAS AND SAME WITH USER DEFINABLE TRANSLATIONS

RELATED APPLICATIONS

This application is a provisional application of 60/138,306, which was filed Jun. 9, 1999, entitled Alphanumeric Paging Derived from Decoded Specific Area Message Encoded (SAME) Messages.

BACKGROUND OF THE INVENTION

Since the early 1990's the National Weather Service (NWS) has been broadcasting digitized weather warning header information concerning the nature and scope of the content of the alert message following the header. The digitized header is transmitted in a special AFSK data format, called Specific Area Message Encoding (SAME). SAME is a subset of the Emergency Alert System (EAS) as defined in Part 11 of the FCC rules set out in the United States Code of Federal Regulations.

This system uses specific ASCII character event codes for data fields such as severe weather events, geographic area of the alert time etc. Sophisticated receivers and decoders are required to recover and decode the digital header information.

A number of patents have been granted on various aspects of the SAME system including U.S. Pat. No. 5,548,323 to Callahan; U.S. Pat. No. 5,917,887 to Fesler; U.S. Pat. No. 5,995,553 to Crandall; and B1 U.S. Pat. No. 5,121,430 to Ganzer. Other emergency alert decoding schemes were disclosed in Martinez, patent U.S. Pat. No. 4,415,771.

Alphanumeric paging, alphanumeric paging terminals, the activation of alphanumeric paging thorough alphanumeric paging terminals by alarm systems, automatic alphanumeric paging of weather, and the activation of alarm systems by decoded alert signals are all known in the art.

Examples of premise alarm systems reporting alarm status to a central station are taught by U.S. Pat. No. 4,141,006 to Braxton; U.S. Pat. No. 3,523,162 to Streit; U.S. Pat. No. 3,761,914 to Hardy et al.; U.S. Pat. No. 3,686,654 to Judlowe; U.S. Pat. No. 3,714,646 to Nurnberg et al.; U.S. Pat. No. 3,855,590 to Neuner and U.S. Pat. No. 3,855,456 to Summers et al.

SUMMARY OF THE INVENTION

At least three major problems have been found in the current state of the art with SAME decoding methods. The first being SAME is technically difficult to decode because of its engineering design scheme. There are many reason why a SAME message might not decode. The user will usually not know the reason that the message did not decode thereby preventing the undertaking of corrective procedures.

The second major problem is that there are numerous different applications for the decoded message, which change over time due to individual need and law changes, and the user has no easy way of customizing the output of the alert message format to optimize system performance for his particular needs.

A third major problem is having an easy way to forward the decoded and translated SAME message to other communications systems such as PCS, email, LED sign boards and alphanumeric paging.

This invention addresses these problems by teaching a method and apparatus using LED's, non volatile memory, an LCD, microcontrollers and a keypad to quickly determine the decoding status of EAS and SAME messages; a method and apparatus for the user to define the translation of these messages into custom text messages, abbreviations and different languages; and an efficient method and apparatus for interfacing the decoded messages to alphanumeric paging, personal communication text messaging services, internet, email and remote LED signboards through modems and alphanumeric paging terminals.

BRIEF DESCRIPTION OF THE DRAWINGS

FIG. 7 is a detailed breakdown of the SAME protocol.

OBJECTS AND ADVANTAGES OF THE INVENTION

An object of this invention is to use indicator lights to show the user the real time status of the decoded message and the decoder without sophisticated and expensive electronic test equipment.

Another object of this invention is an easy method for the user to upload customized SAME code message translations into the SAME decoder.

Another object of this invention is an easy method for the user to upload translations of SAME codes in different languages into the SAME decoder.

Another object of this invention is to permit the user to upload full length translations and also abbreviations into the receiver for different end uses into the SAME decoder.

Another object of this invention is to permit the user to upload new codes as desired or as required by law, without having to download software or obtain and install a new EPROM with new software.

Another object of this invention is to integrate an alphanumeric paging terminal into an SAME decoder to permit cost efficient alphanumeric paging of the decoded SAME messages.

Another object of this invention is to integrate a modem into the SAME decoder to permit cost efficient alphanumeric paging and the placement of decoded alert messages on email and Personal Communication System applications.

Another object of this invention is to provide modem and pager interfaces to automatically place alert messages on LED sign boards at remote locations.

DETAILED DESCRIPTION OF THE INVENTION

Detailed embodiments of the SAME decoder are disclosed herein, however it will be understood that the disclosed embodiments are exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The EAS and SAME alerting systems are public domain national alerting systems. The EAS Protocol is published at 47 CFR 11.31. The National Weather Services (NWS) Specific Area Message Encoding (SAME) system is compatible with the federal EAS system.

Figure 1:
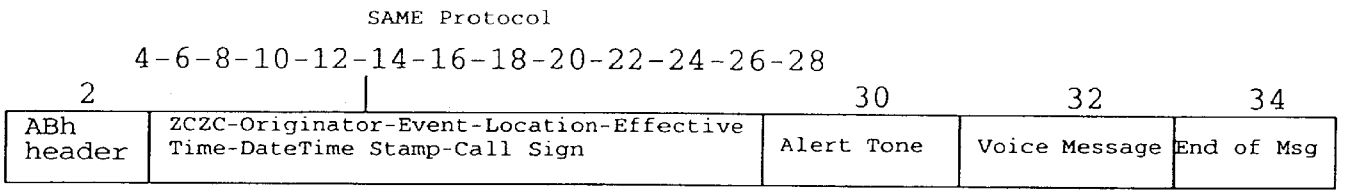
FIG. 1 is a block diagram of the SAME protocol.

Referring to FIGS. 1 and 7, the EAS protocol has the following components, some of which are constant and some of which are variable, depending on the portion of the message.

There is always a preamble 2 consisting of sixteen 8 bit bytes of ABh (hex) with the binary format 10101011. The preamble 2 is always followed by the SAME or EAS protocol 4 which has a number of fields.

Preamble 2 is always followed by the ASCII letters "ZCZC." The "ZCZC" is followed by originator code 6 which consists of a variable code of three ASCII capital letters. For example, originator code 6 of "NWS" means the National Weather Service was the originator of the alert message.

Originator code 6 is always followed by a variable code of three ASCII capital letters for event 8. For example, the event code 8 for a Tornado Warning is "TOR."

Event code 8 is always followed by at least one and up to thirty one location codes 10. Location code 10 is in turn made up of three components based on ASCII numbers. These are a single digit 0–9 for portion of county 12; which is in turn followed by a two number code for state 14; which is in turn followed by a three digit number representing the county 16 within state 14. State 14 and county 16 codes are based on the Federal Information Processing System (FIPS) codes administered by the National Institute of Standards and Technology (NIST).

The location code(s) 10 are followed by a four digit valid time 18 for the message. Thus "0130" would mean the message is effective for the 1 hour and 30 minutes following the issuance of the alert.

Valid time 18 is followed by a complex time and date stamp 20. The time and date stamp is made up of a Julian Calendar day of the year 22. Julian Calendar day of the year 22 is followed by a 2 digit hour field 24 which is in turn followed by a 2 digit minute 26 field.

Time and date stamp 20 is followed by the identification of the broadcast system 28 in eight characters and/or numbers.

The entire preamble 2 and SAME protocol 4 are sent three times for each activation in order to permit the SAME decoder 52 to match two of three alert messages 54 for verification purposes.

Preamble 2 and SAME protocol 4 are followed by an alert tone 30, which is often the 1050 Hz alert tone. Alert tone 30 is followed by a voice alert message 32.

Voice alert message 32 is followed by an end of message signal 34 which consists of preamble 2 followed by four ASCII N's. End of message signal 34 is also sent three times.

The entire digital portion of alert message 54 consisting of preamble 2, SAME protocol 4 and end of message 34 portions are sent in Audio Frequency Shift Keying format (AFSK) at a baud rate of 520.83 bits per second with 2083.3 Hz being the mark frequency and 1562.5 Hz being the space frequency.

There are no start or stop bits and the data is sent in a continuous stream.

These code complexities and technical specifications make SAME message 54 difficult to decode with the intention of making a secure system to avoid unauthorized alarms.

Figure 2:
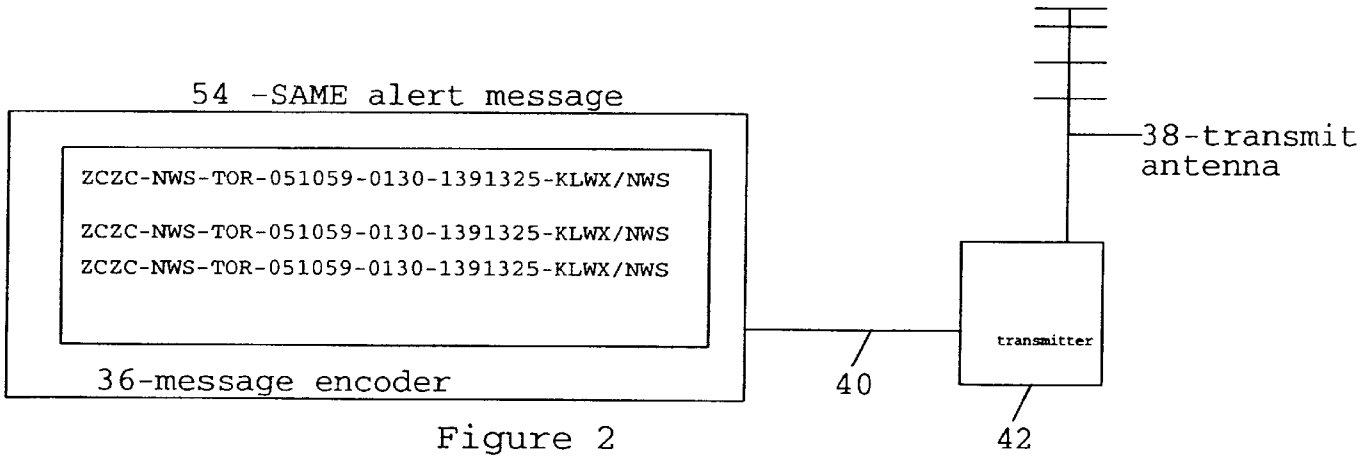
FIG. 2 is a block diagram of the encoder.

The unintended effect of these code complexities and technical specifications, when combined with the often distant and weak transmitted signal, which is often further attenuated due to bad weather conditions such as lightning, is a fair amount of unreliability. Additionally, referring to FIGS. 2 and 3, if the entire communication system is not up to technical specifications the SAME protocol 4 will be especially difficult to decode. Such problems include wrongly encoded message at the message encoder 36 by the operator; low audio level from the transmitter 42; noise on the telephone signal transmission 40 to transmitter 42; assorted problems with the transmitter 42 including noise in the components, low power and transmit antenna problems 38; distance of receiver 46 from transmitter 42; type and location of reception antenna 44; locally generated RF noise near the receiver 46; and quality, sensitivity and selectivity of the receiver 46.

The improved SAME decoder 52 described herein addresses the inter-related problems of diagnosing the many steps of decoding and translating the alert message 54.

Figure 3:
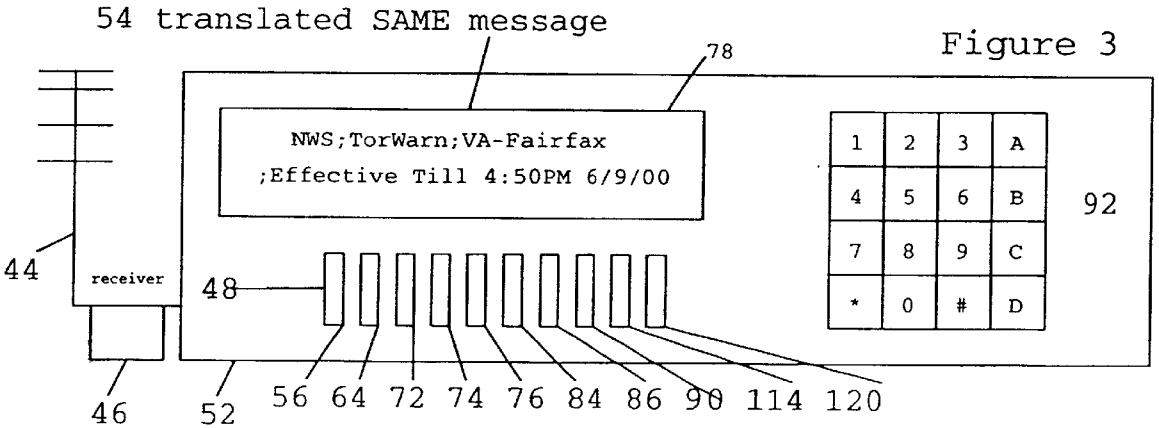
FIG. 3 is a front planar view of the SAME decoder, receiver and antenna.
Figures 4, 5, 6:
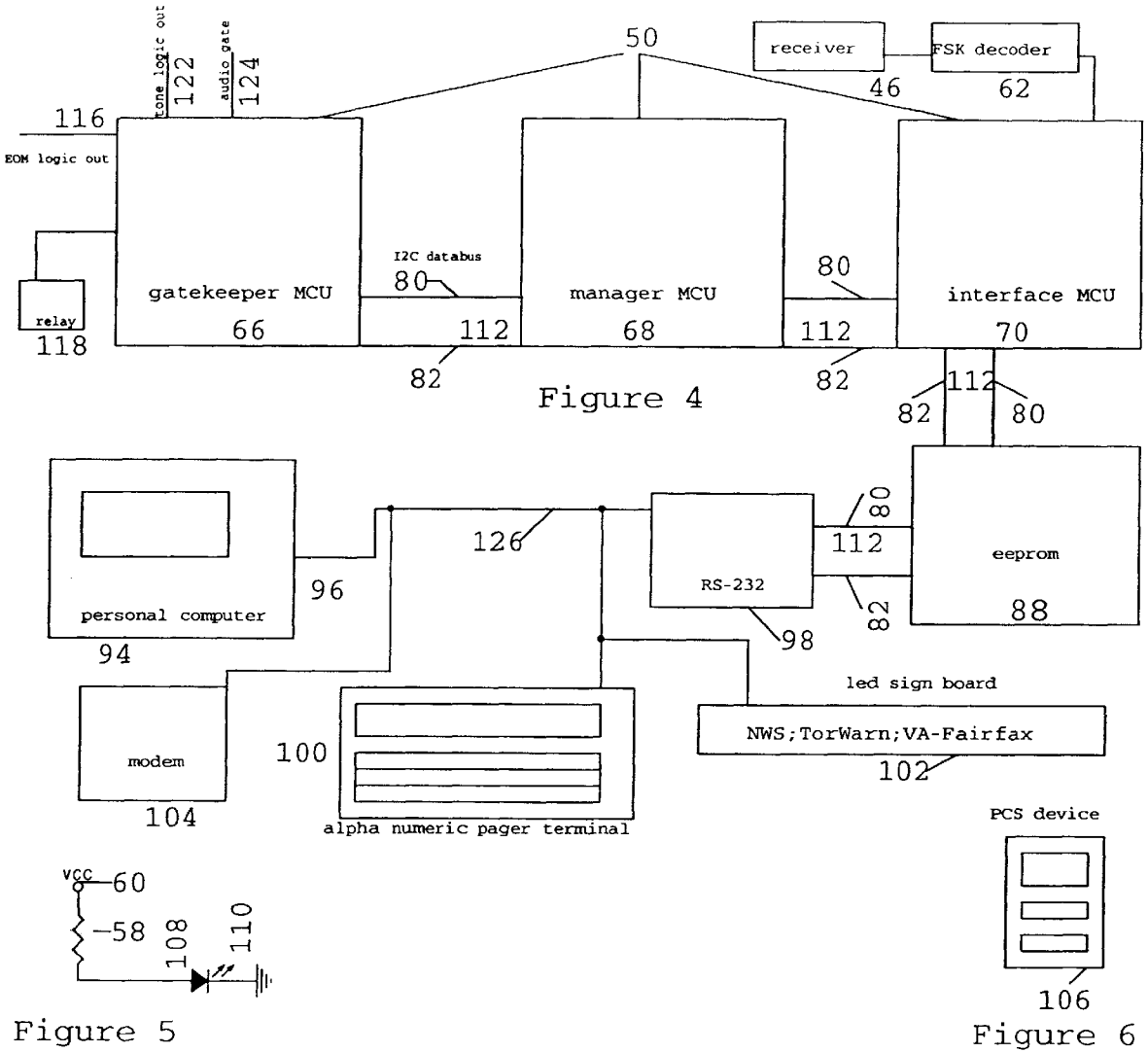
FIG. 4 is a block diagram of the main electronic components of the SAME decoder and peripherals.
FIG. 5 is an electrical diagram of an LED.
FIG. 6 is a block diagram of a PCS device.

In the preferred embodiment, referring to FIGS. 3, 4 and 5, an LED light bar 48, consisting of multiple LEDS in one package, is used as an immediate and efficient way to indicate the status of decoding SAME message 54 in addition to indicating the status of the microcontrollers 50 in the SAME decoder 52.

It will be understood that many variations of the LED light bar 48 can be configured to test for different aspects of the decoding of the SAME message 54 and many different light or other information emitting sources can be substituted for the LED light bar 48 without departing from the nature of this invention.

Generally, each individual LED anode 108 in the LED light bar 48 has a pull up resistor 58 tied to the 5 volt power bus 60. Each LED is lit by providing a path to ground from the cathode 110 of each LED.

In the preferred embodiment one of the LED's in the LED light bar 48 can be configured to detect whether there is DC power, usually 5 volts, powering the SAME decoder 52. The cathode 110 of the power LED 56 is tied to ground and the anode 108 is tied to the +5 volt power bus 60, as is shown in FIG. 5.

Another LED in the LED light bar 48 is used to detect whether the FSK decoder 62 has detected audio within the SAME audio passband of approximately 1562 Hz to 2083 Hz. The cathode 110 of the FSK decode LED is tied to the Data Out Not pin of the FSK Decoder 62. As normal spoken audio, which is usually present on the channel being monitored, randomly passes through this audio passband, the FSK LED 64 will light in a similar random fashion which indicates that there is sufficient audio into the FSK decoder 62 and that the FSK decoder 62 is operational in converting the analog audio into a digital stream for further processing.

It will be understood that the core functions of the three microcontrollers 50 are discussed herein, namely gatekeeper 66, manager 68 and interface 70 may be integrated into a single microcontroller 50 depending on software considerations and future microcontroller capabilities. Therefore, the three microcontrollers 50 should be understood to be functional blocks within the SAME decoder 52 system.

The digital FSK output from the FSK decoder 62 is constantly monitored by the gatekeeper microcontroller 66 looking for the ABh preamble 2 and then the ZCZC of the SAME protocol 4. Upon detecting a valid ABh preamble 2 SAME led 72 will be turned on by the gatekeeper microcontroller 66. The cathode of the SAME led 72 is connected to an I/O pin of the gatekeeper microcontroller 66.

If the ABh header is not immediately followed by a valid ZCZC from the SAME protocol 4, the SAME led 72 will be turned off by the gatekeeper microcontroller 66. This entire process of determining a valid ABh preamble 2 and whether a valid SAME protocol 4 has been detected normally takes less than 500 milliseconds. Thus, since it is fairly common for normal random voice to randomly trigger the FSK decoder 62 to send an ABh to the gatekeeper microcontroller 66, the SAME led 72 will randomly flash when the FSK decoder 62 and the gatekeeper microcontroller 66 are operating normally. The user can determine that the audio source, FSK decoder 62 and gatekeeper microcontroller 66 are functional by seeing FSK led 64 and SAME led 72 randomly flash in response to normal audio input into the SAME decoder 52. If these LEDS are not flashing, the user is immediately alerted to possible problems with no or low audio signal into the SAME decoder 52 or a problem with the gatekeeper microcontroller 66.

When an actual SAME protocol message 4 is being received, both FSK led 64 and SAME led 72 will stay on steadily until the end of SAME protocol 4 message. If during an actual SAME protocol 4 message FSK led 64 does not stay on steadily, this means that the reception of the SAME protocol 4 signal is so poor that the audio frequencies are dropping out of the designated passband. The user will then know that there is either a problem with the transmission of the SAME protocol 4 or with the reception thereof.

If the FSK led 64 falls out of lock during the reception of the SAME protocol 4 message and the signal is subsequently reacquired in the middle of a SAME protocol 4 message, the FSK led 64 will lock onto the signal, but the SAME led 72 will not relock as the middle of the SAME protocol 4 signal will not contain the ABh preamble 2 followed by the ZC of the SAME protocol 4. This gives the user an immediate indication that the digital SAME protocol 4 message did not decode although the signal was reacquired in mid message.

Once the gatekeeper microcontroller 66 has determined that a valid SAME protocol 4 message is incoming, the gatekeeper microcontroller 66 sends a logic signal to the data 68 and interface 70 microcontrollers to have them interrupt all current functions and to standby for a new alert message 54. This interrupt function is critical in that a SAME protocol 4 alert can come at anytime and the on board data bus 112 must be cleared to be ready to process a new SAME protocol 2 alert message 54. Many times, due to a sending error by the originator 6, a second SAME protocol 4 alert message 54 will be issued before the previous SAME protocol alert message 54 can be completely processed. Prior art receivers have either jammed or lost the alert message 54 when this occurred. This interrupt function makes sure that the latest SAME protocol 4 alert message 54 has top priority and ongoing processing functions of the SAME decoder 52 will not interfere with a new incoming alert message 54. Upon receiving the interrupt request from the gatekeeper microcontroller 66, the data manager microcontroller 68 will light the data interrupt led 74 and the interface microcontroller 70 will light the interface led 76 through respective led cathodes 108 pulled low on a microcontroller input.

Data interrupt led 74 will remain lit for the duration of the processing of the data by data manager microcontroller 68.

Interface led 76 will remain lit until the automatic data display functions, such as displaying the data on the data display LCD 78 are complete, which occurs after the completion of processing of the data by the data manager microcontroller 68.

These LEDS tell the user not only when a valid SAME protocol 4 message has been detected, but also when the data manager microcontroller 68 and interface microcontroller 70 have completed their automated tasks. Many on board inter circuit communication protocols, now known or in the future invented, can be used to move data around the FSK decoder 62 board. One such common communication method is the Phillips developed I2C protocol which uses a two wire data bus, one wire being for serial clock 80 and one wire being for serial data 82. If the I2C bus gets "jammed", various components on the bus will hold one or both of these lines low. Thus serial clock LED 84 and serial data LED 86 were added to quickly determine the status of the I2C data bus.

If data is being correctly processed on the I2C bus, the serial clock 84 and serial data 86 LEDS will flash as the data is moving along the data bus. The LEDS will often flash so quickly when data is being properly processed that they will appear to be locked on with a steady light, which will go completely off at the end of the processing of alert message 54 and other data.

Serial clock led 84 and serial data led 86 will have a distinctive pulse flash as each SAME protocol 4 message is saved to non volatile memory eeprom 88. Should a valid SAME protocol message not be received, the message will not be saved to eeprom 88 and the serial clock 84 and serial data 86 LEDS will not give the distinctive pulse flash. This immediately tells the user that the SAME protocol 4 message had so many errors that it was not saved. Once the entire SAME protocol 4 alert message 54 has been received, both FSK led 64 and the SAME led 72 LEDS will be turned off by the gatekeeper microcontroller 66.

SAME protocol 4 alert message 54 is followed by an alert tone 30. This alert tone can be detected by the gatekeeper microcontroller 66 and the tone led 120 will be lit by the cathode 108 of this led being held low by the gatekeeper microcontroller 66. The gatekeeper microcontroller 66 will also toggle a tone logic output 122. This feature is especially important where the SAME protocol 4 alert message 54 fails to decode or is not sent for special warning such as Special Marine Warnings where, for the moment, there are no county equivalent FIPS codes for the Marine Areas. If a tone is detected, the SAME decoder 52 will activate with a "tone only" message on the LCD display 78 and on other peripherals. This immediately tells the user that the message was either tone only, or that the SAME protocol 4 did not properly decode.

The alert tone 30 is followed by a voice message 32 which is in turn followed by an End of Message 34 FSK digital signal. The gatekeeper microcontroller 66 will activate an End of Message LED 114 and an End of Message logic output 116 to control various functions external to the SAME decoder 52. It is important for the user to know if an End of Message 34 signal was decoded, as there have been problems with prior art units that were forced to time out if the End of Message 34 signal was not decoded. The End of Message LED 114 also indicates that at least the End of Message 30 signal was decoded and the user should review the received alert messages 54 to determine the nature of the entire SAME protocol 4 message.

One such function could be, for example, a relay 118 or other audio gate 124 to have the audio be placed on other communication systems only for certain SAME protocol 4 codes and/or only starting after the end of the SAME protocol 4 message and before the End of Message 34 signal.

A system status OK led 90 shows the system is not in interrupt or jammed and is ready to respond to the next SAME protocol 4 message. This led can be controlled by the data manager 68 and/or the interface 70 microcontrollers.

While the above LEDS give the user a simple and clear picture of the real time status of the decoding of the SAME protocol 4 messages 54 from analog FSK into digital into ASCII formats, the ASCII message must be further translated to be of further use to the user. Because of the complex nature of the information embedded within the fields of the SAME protocol 4, errors may appear at any step before the completion of the decoding process 23 and the system described herein teaches an efficient method and apparatus for the user to be able to trace each step in the decoding and translation process once the SAME protocol 4 message 54 has been saved into nonvolatile eeprom 88.

The SAME protocol 4 calls for three repetitions of each alert message 54. Due to the above mentioned technical problems none, one, two or three alert messages 54 may actually be decoded by the SAME decoder 52. Officially, two alert messages 54 must match before a alert message 54 is considered accurate. This may not always be possible if only one alert message 54 is decoded.

Therefore it is important for the user to have a complete picture of how many of the three SAME protocol 4 alert messages 54 were received and decoded by the SAME decoder 52 and what was the content of each alert message 54 which was decoded. Each alert message 54 needs to be able to be reviewed by the user to determine whether the entire ASCII alert message 54 decoded and whether the correct SAME protocol 4 ASCII codes were transmitted and received for the particular event 8.

This process is efficiently handled by allocating three memory bins in eeprom 88 to receive the up to three SAME protocol 4 alert messages 54.

SAME decoder 52 tags each alert message 54 by replacing each ZCZC with ZC#0, ZC#1 or ZC#2. At the end of the SAME protocol 4 alert sequence, the user, by pressing a key on the keypad 92 can scroll through the three memory bins in eeprom 88, with the data displaying on LCD display 78. In this way, the user can quickly determine how many of the three SAME protocol 4 alert messages 54 were received and the content thereof.

The next step in the decode process is to choose one of the up to three SAME protocol 4 alert messages 54 to further process and translate. The selection is made by an algorithm such as a bit by bit comparison of the received data to determine whether two messages 54 were identical and to choose on of these two alert messages 54 for further processing.

The chosen and tagged received SAME protocol 4 alert message 54 is then copied to another portion of the eeprom 88 by the manager microcontroller 68 via the I2C databus 112. The user can see which of the three bursts were selected for further processing by pressing a key on the keypad 92 for display on the LCD display 78 and viewing the "ZC" numbered tag.

The next step in the decode and translation process is to match the received codes 6,8,10,12,14,16 with the pre saved codes to determine whether activation of the alert system is required. This is handled by a simple string matching algorithm between the chosen message and the pre selected sought after strings. The preselected information may be entered into the SAME decoder 52 by the keypad 92. The preselected data is saved in the eeprom 88. The user can view the pre selected codes on the LCD display 78 through keypad 92 functions.

The next step, whether or not a match is found, is to translate the alert message 54 from coded SAME protocol 4 ASCII into a more understandable format such as plain English and/or abbreviations.

An ongoing problem with the EAS and SAME protocols 4 is the revision and/or addition of received codes 6,8,10, 12,14,16 as required by law and/or as needed by the user. Many prior art receivers require the manual insertion of new software, often in the form of eproms, obtained at time and expense to all parties to be inserted into the SAME decoder 52 in order to keep it working. The software in many consumer grade prior art receivers cannot be upgraded as the software was placed in One Time Programmable (OTP) eeproms 88.

The requirement for having to specially obtain software upgrades has at least two major drawbacks. First, the new software must be obtained from the manufacturer at a moderate amount of time and expense and manually installed and configured for the receiver to keep working. Second, the user is often limited to the translation table between the coded ASCII SAME protocol 4 codes as defined by the manufacturer thereby making translation of the lookup table codes correlated to the SAME protocol 4 alert messages 54 into other languages and/or abbreviations difficult if not impossible.

SAME decoder 52 handles all of these problems by permitting the cross reference translation tables between ASCII SAME protocol 4 codes and the translation to be formatted as a plain text document on a personal computer 94 and uploaded into SAME decoder 52 from the serial communication port 96 on the personal computer 94 into a serial communication port 98 on the SAME decoder 52. The serial communication port 98 on the SAME decoder 52 may be an RS-232 format with standard baud rate for connection with optional serial cable 126. A universal synchronous asynchronous receiver transmitter on the manager 68 or interface 70 microcontrollers may be used to move ASCII lookup table data from the personal computer 94 through the I2C database 112 to the eeprom 88 for later recall during the alert message 54 decoding process. Additionally, the software to perform this editing and transfer may be posted on a web site for direct editing and subsequent downloading in SAME decoder 52.

The translation tables are loaded into the eeprom 88 by a computer algorithm on the manager 68 and/or interface 70 microcontroller by entering the database load mode by pressing a key on the keypad 92.

In this manner the user can configure the translation table to be anything that is desired currently or is needed in the future as the evolving SAME protocol 4 requires. Additional benefits include the ability to use abbreviations for long event and county names. For example, a SEVERE THUNDERSTORM WARNING may be abbreviated as Svr.T-Strm.Warn. and City of Manassas City Park, Va. may be abbreviated as VA-ManCityPk.

This abbreviation can be critical when trying to get the decoded SAME protocol 4 alert message 54 onto devices with limited text capacity such as alpha numeric pagers and LED sign boards.

Additionally different languages may be used for the translation tables in order to make the warning available to people who speak different languages such as Spanish, French, German, Japanese or Italian.

Additionally, multiple translation databases can be created where abbreviated messages are sent to certain end user functions with limited data handling capabilities such as LCD, alpha numeric pagers and LED sign boards 102 while the full text can be sent to other devises such as personal computers, email, personal communication devices 106, FIG. 6, and printers. The user can preselect which translation database is to be sent to which peripheral in a setup function which is accessed through keypad 92 and is saved in eeprom 88.

As the SAME decoder 52 reformats the non standard SAME protocol 4 message into standard data formats and the SAME decoder 52 has a serial communication port 98, the SAME decoder 52 can easily place the translated messages onto other communications devices. These include sending the message to an alphanumeric paging terminal 100 for automatic forwarding to pagers preselected depending on the content of the alert message. The code to control these peripherals from the SAME decoder 52 is added to the data stream by the interface microcontroller 70 and is sent to the paging terminal through the serial communication port 98. This data can be preselected by the user and entered into the keypad 92 and saved in eeprom 88. A number of paging terminals have a data control format where the incoming data stream directs the ASCII translated alert message data to certain pagers and/or groups of pagers.

Alternately, many alpha numeric paging terminals 100 have the ability to send precanned messages to preselected pagers upon receiving an external contact closure from the SAME receiver 52 which can be connected to alert receiver 52 logic output ports 116, 118 and/or 122.

Additionally, the alert message 54 can be sent from the SAME decoder 52 through the serial communication port 98 directly to LED sign boards 102 as controlled by the interface microcontroller 70. Further, the alert message 54 can be set to no longer be displayed after the effective time 18 of the alert message 54 has expired by sending an additional ASCII data stream to the LED sign board 102 through the SAME receivers 52 RS-232 serial communication port 98.

Alert message 54 may be sent from SAME receiver 52 via modem 104 to other remotely located communications devices, such as LED signs 102 and email via ISP's in TCP/IP protocol which in turn can be sent to personal communication systems (PCS) devices 106, or to pagers through the internet, or to any other communication system now known or hereinafter developed. Alternately, LED sign boards as is apparent from the above, the alert receiver 52 permits flexible delivery of alert messages 54 to multiple information devices, now known or hereinafter developed.

It is to be understood that while certain forms of the present invention have been illustrated and described herein, it is not to be limited to the specific forms or arrangement of parts described and shown.

What I claim is:

1. A Specific Area Message Encoding and Emergency Alert System decoder comprising status indicating lights for monitoring the real time status of the decoding of an Audio Frequency Shift Keying alert signal.

2. A Specific Area Message Encoding and Emergency Alert System decoder, as recited in claim 1, further comprising a status indication light for detection of said alert signal when the audio frequencies of said alert signal are within the designated audio passband of the Audio Frequency Shift Keying alert signal.

3. A Specific Area Message Encoding and Emergency Alert System decoder, as recited in claim 1, wherein said designated audio passband is in the frequency range of approximately 1563 Hz to 2083 Hz.

4. A Specific Area Message Encoding and Emergency Alert System decoder, as recited in claim 1, further comprising at least one status indication light for detection of said alert signal when a digital string of ABh (10101011) is detected.

5. A Specific Area Message Encoding and Emergency Alert System decoder, as recited in claim 4, wherein said status indication light for detection of said alert signal stays lit if an ASCII "ZC" header is detected after said digital string of ABh has been detected.

6. A Specific Area Message Encoding and Emergency Alert System decoder, as recited in claim 5, wherein said status indication light for detection of said alert signal stays lit until said alert signal has a frequency out of said audio passband.

7. A Specific Area Message Encoding and Emergency Alert System decoder, as recited in claim 6, further comprising a logic output which acts as an interrupt to at least one other microcontroller between the time a ZC has been detected and the time when the audio frequency drops out of said audio passband.

8. A Specific Area Message Encoding and Emergency Alert System decoder, as recited in claim 1, further comprising a status indication light for detection of said alert signal when said decoded message is being saved to non-volatile electrically erasable programmable memory.

9. A Specific Area Message Encoding and Emergency Alert System decoder, as recited in claim 8, wherein a status indication light for detection of said alert signal detects the serial clock signal when said decoded message is being saved to non-volatile electrically erasable programmable memory.

10. A Specific Area Message Encoding and Emergency Alert System decoder, as recited in claim 8, wherein a status indication light for detection of said alert signal detects the serial data signal when said decoded message is being saved to non-volatile electrically erasable programmable memory.

11. A Specific Area Message Encoding and Emergency Alert System decoder, as recited in claim 1, further comprising a status indication light for detection of said alert signal when the End of Message signal has been decoded.

12. A Specific Area Message Encoding and Emergency Alert System decoder, as recited in claim 11, further comprising a status indication light for the detection of a prespecified audio tone.

13. A Specific Area Message Encoding and Emergency Alert System decoder, as recited in claim 1, further comprising means for visually reviewing at least the last three Specific Area Message Encoding or Emergency Alert System bursts received.

14. A Specific Area Message Encoding and Emergency Alert System decoder, as recited in claim 13, wherein said last three Specific Area Message Encoding or Emergency Alert System bursts are visually reviewed on an liquid crystal display with the data being retrieved from non-volatile memory.

15. A Specific Area Message Encoding and Emergency Alert System decoder, as recited in claim 14, wherein the message chosen to be translated or further processed can be reviewed on liquid crystal display with the data being retrieved from nonvolatile memory.

16. A Specific Area Message Encoding and Emergency Alert System decoder, as recited in claim 1, further comprising means for the user to create and save custom translation codes to a database saved in non volatile memory within the decoder.

17. A Specific Area Message Encoding and Emergency Alert System decoder, as recited in claim 16, wherein said custom translation are abbreviations for the originator, event, state or county information fields.

18. A Specific Area Message Encoding and Emergency Alert System decoder, as recited in claim 16, wherein said custom translation codes are for any language.

19. A Specific Area Message Encoding and Emergency Alert System decoder, as recited in claim 1, further comprising more than one custom alert code translation database, wherein different messages are forwarded to different end users such as pagers, light emitting diode sign boards and e-mail depending on the content of the message.

20. A Specific Area Message Encoding and Emergency Alert System decoder, as recited in claim 1, further comprising means to place the output alert message on an alpha numeric paging terminal for forwarding of either precanned messages, or translated messages to alpha numeric pagers depending on the content of the message.

21. A Specific Area Message Encoding and Emergency Alert System decoder, as recited in claim 1, further comprising means to place the output alert message via modems to email or light emitting diode sign boards or other communication devices depending on the content of the message.

22. A Specific Area Message Encoding and Emergency Alert System decoder, as recited in claim 1, wherein each alert message is automatically tagged to be able to determine how many of the three bursts were received.

* * * * *